US012228119B2

(12) United States Patent
Hahn et al.

(10) Patent No.: US 12,228,119 B2
(45) Date of Patent: Feb. 18, 2025

(54) NOISE REDUCTION MEDIA FOR A RECIPROCATING COMPRESSOR

(71) Applicant: Haier US Appliance Solutions, Inc., Wilmington, DE (US)

(72) Inventors: Gregory William Hahn, Mt. Washington, KY (US); Michael Goodman Schroeder, Crestwood, KY (US); Brent Alden Junge, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 129 days.

(21) Appl. No.: 17/994,604

(22) Filed: Nov. 28, 2022

(65) Prior Publication Data

US 2024/0175434 A1 May 30, 2024

(51) Int. Cl.

| | |
|---|---|
| ***F04B 39/00*** | (2006.01) |
| ***F04B 35/04*** | (2006.01) |
| ***F04B 39/02*** | (2006.01) |
| ***F04B 39/12*** | (2006.01) |

(52) U.S. Cl.

CPC ..... *F04B 39/0027* (2013.01); *F04B 35/045* (2013.01); *F04B 39/0261* (2013.01); *F04B 39/123* (2013.01)

(58) Field of Classification Search

CPC .. F04B 35/04; F04B 39/0027; F04B 39/0261; F04B 39/123; F04C 15/0088

See application file for complete search history.

(56) References Cited

U.S. PATENT DOCUMENTS

| | | | | |
|---|---|---|---|---|
| 2009/0232672 | A1 | 9/2009 | Ota | |
| 2020/0355176 | A1 | 11/2020 | Hahn et al. | |
| 2022/0387907 | A1* | 12/2022 | Tilz | B01D 24/105 |

FOREIGN PATENT DOCUMENTS

| | | | |
|---|---|---|---|
| KR | 100199281 | B1 | 6/1999 |
| KR | 101428815 | B1 | 8/2014 |

* cited by examiner

*Primary Examiner* — Charles G Freay
(74) *Attorney, Agent, or Firm* — Dority & Manning, P.A.

(57) ABSTRACT

A compressor includes a housing defining a sump for collecting lubricant, a pump for circulating the lubricant within the housing, the pump comprising a lubricant intake tube defining a pump inlet positioned within the sump, and a noise dissipation media positioned within the sump on a surface of the lubricant and above the pump inlet, wherein a media void is defined around the lubricant intake tube.

20 Claims, 8 Drawing Sheets

NOISE REDUCTION MEDIA FOR A RECIPROCATING COMPRESSOR

FIELD OF THE INVENTION

The present subject matter relates generally to reciprocating compressors, and more particularly, to noise reduction features for use in reciprocating compressors.

BACKGROUND OF THE INVENTION

Certain refrigerator appliances include sealed systems for cooling chilled chambers of the refrigerator appliance. The sealed systems generally include a compressor that generates compressed refrigerant during operation of the sealed system. The compressed refrigerant flows to an evaporator where heat exchange between the chilled chambers and the refrigerant cools the chilled chambers and food items located therein. Recently, certain refrigerator appliances have included reciprocating compressors, such as linear compressors, for compressing refrigerant. Linear compressors generally include a piston and a driving coil. The driving coil generates a force for sliding the piston forward and backward within a chamber. During motion of the piston within the chamber, the piston compresses refrigerant.

Notably, during operation of a linear compressor, oil spray within the compressor may generate significant noise. For example, where oscillating portions of the compressor strike the oil within the sump, oil is sprayed onto other components, such as the housing, thereby generating excessive noise. For example, such noise may contribute about 5 dB or more to the overall noise level of the compressor. These elevated noise levels may be unsuitable for certain compressor applications and are frequently a nuisance to the user of the linear compressor. For example, the largest contributor to noise in a refrigerator application is typically the compressor, and this noise is a source of customer dissatisfaction.

Accordingly, a reciprocating compressor with features for improved noise reduction would be desirable. More particularly, a reciprocating compressor with features for reducing noise generated by oil within the sump would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a compressor is provide that defines an axial direction and a vertical direction and includes a housing defining a sump for collecting lubricant, a pump for circulating the lubricant within the housing, the pump comprising a lubricant intake tube defining a pump inlet positioned within the sump, and a noise dissipation media positioned within the sump on a surface of the lubricant and above the pump inlet, wherein a media void is defined around the lubricant intake tube.

In another exemplary embodiment, a noise dissipation media for use in a linear compressor is provided. The linear compressor includes a housing defining a sump and a lubricant intake tube defining a pump inlet positioned within the sump. The noise dissipation media includes at least one of a buoyant mat defining one or more apertures and a tube aperture configured to receive the lubricant intake tube and define a media void around the lubricant intake tube or a plurality of floating balls.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
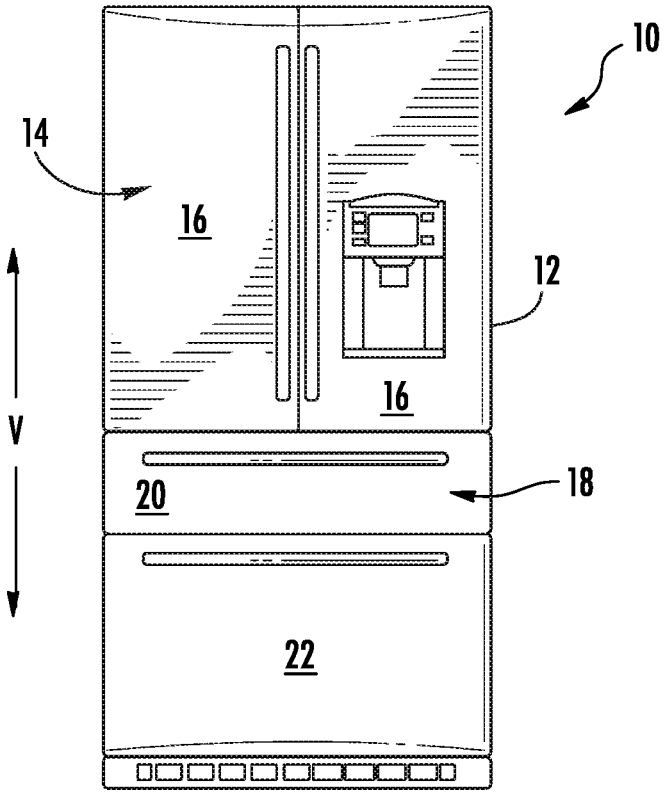
FIG. 1 is a front elevation view of a refrigerator appliance according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
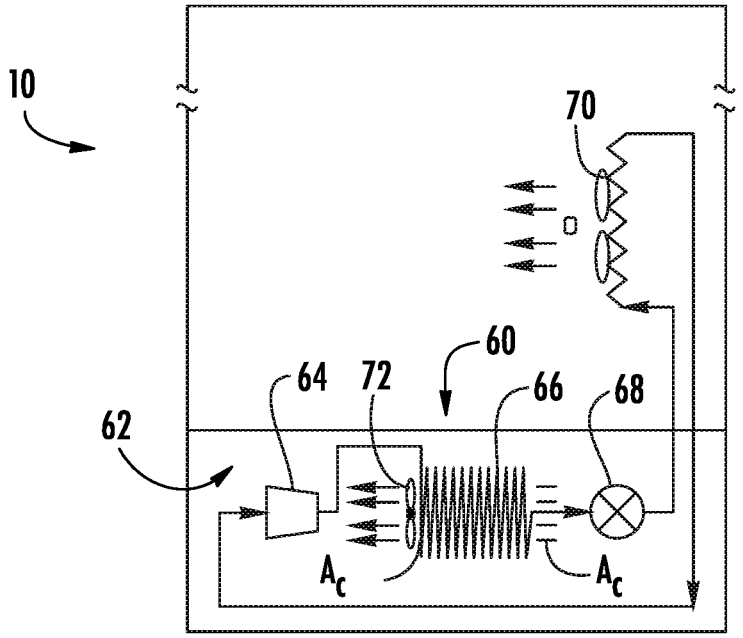
FIG. 2 is schematic view of certain components of the example refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated example embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device 68 (e.g., a valve, capillary tube, or other restriction device) receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well. Furthermore, it should be appreciated that terms such as "refrigerant," "gas," "fluid," and the like are generally intended to refer to a motive fluid for facilitating the operation of refrigeration system 60, and may include, fluid, liquid, gas, or any combination thereof in any state.

Figure 3:
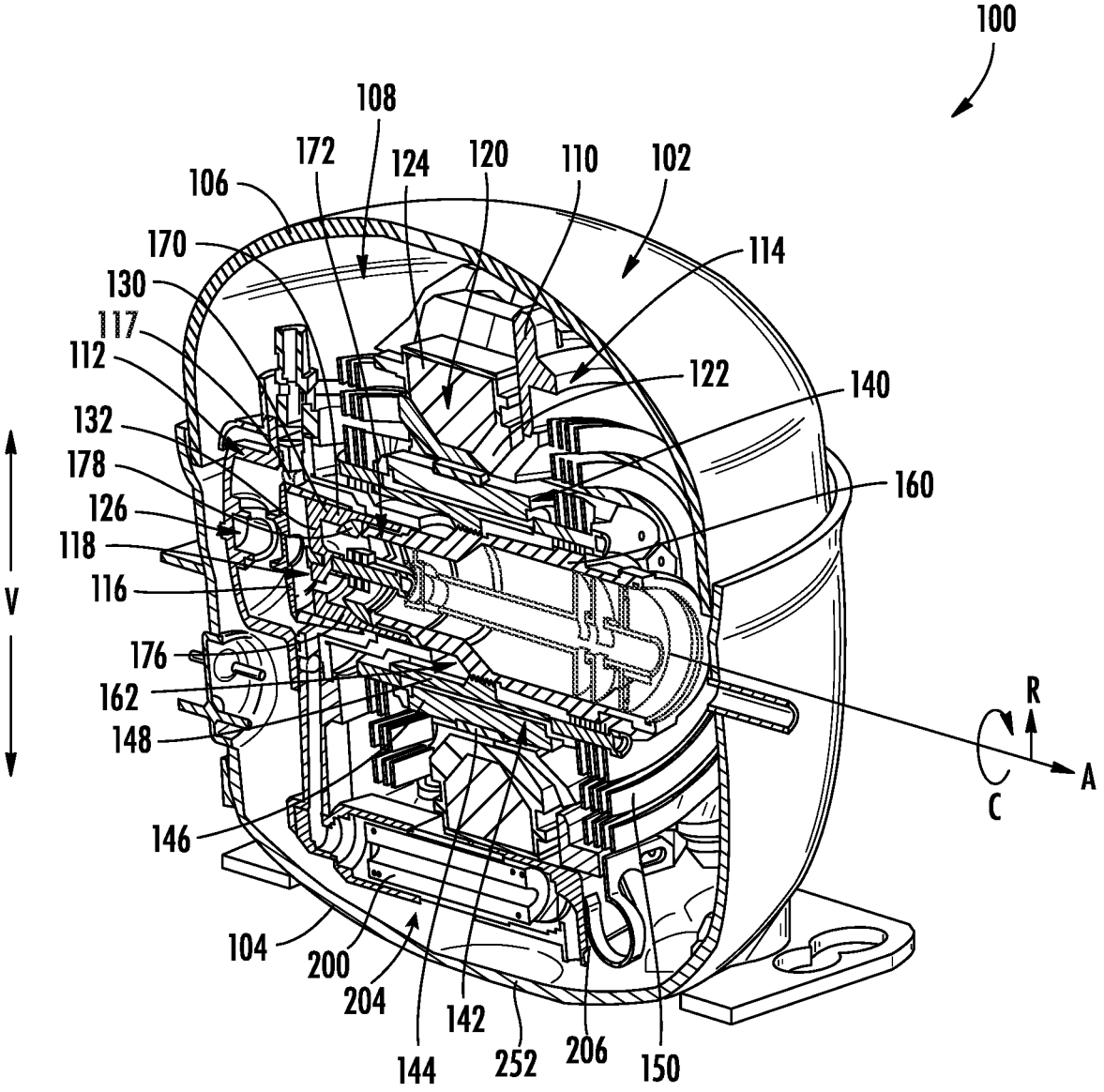
FIG. 3 is a perspective, section view of a linear compressor according to an exemplary embodiment of the present subject matter.
Figure 4:
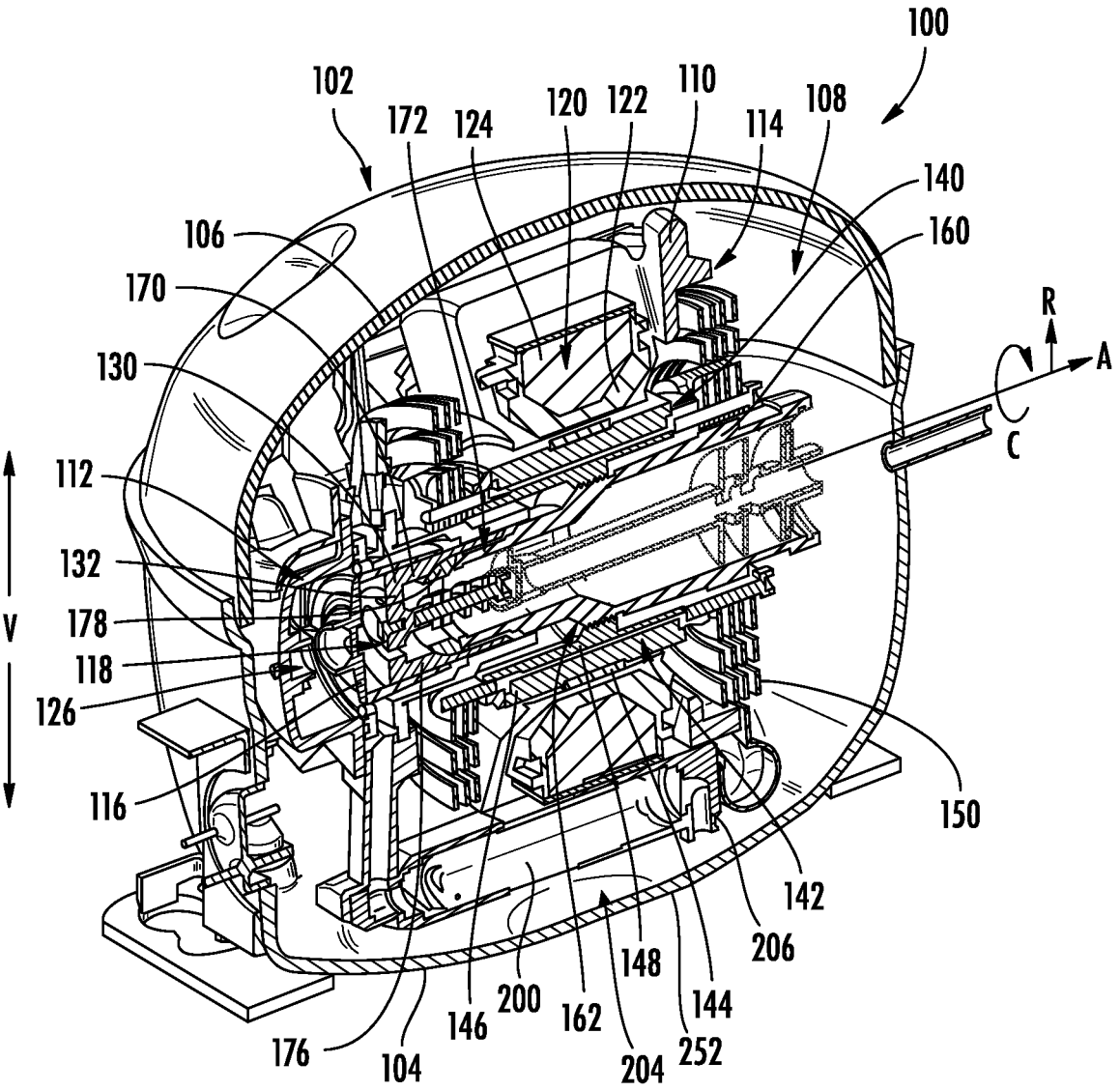
FIG. 4 is another perspective, section view of the exemplary linear compressor of FIG. 3 according to an exemplary embodiment of the present subject matter.
Figure 5:
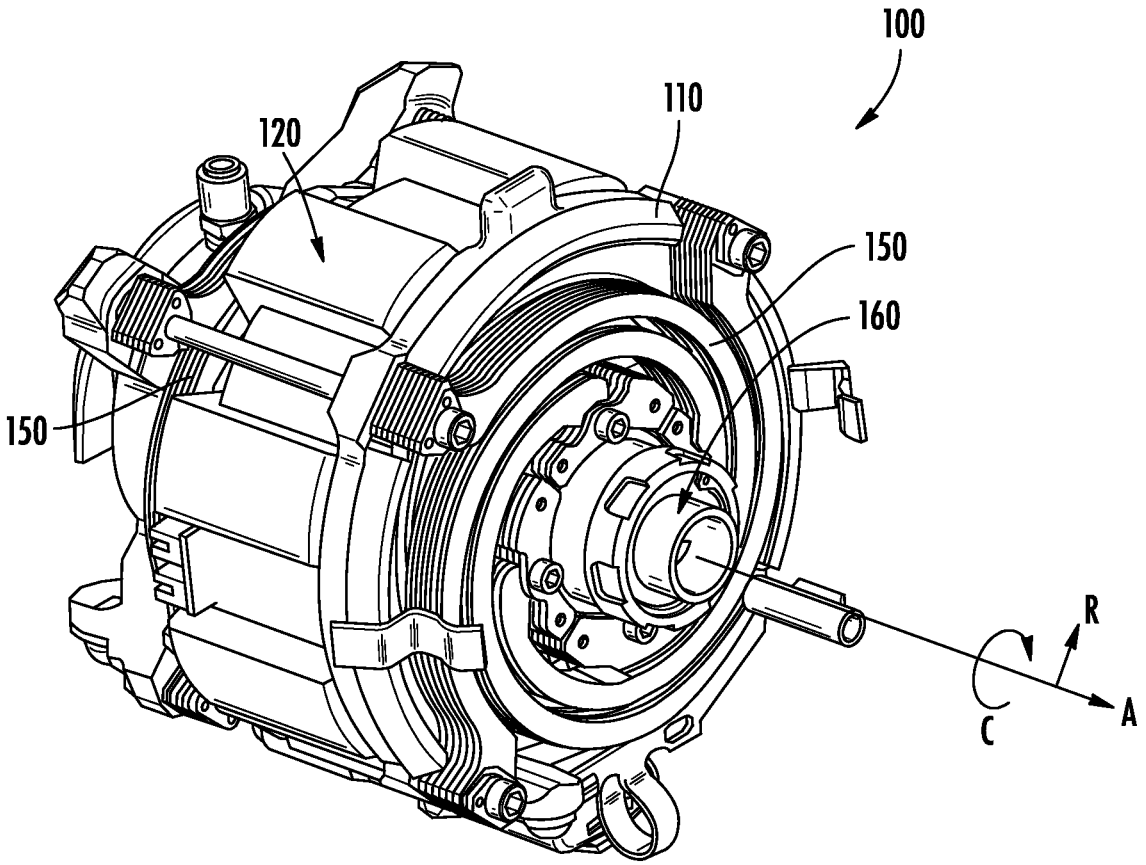
FIG. 5 is a perspective view of a linear compressor with a compressor housing removed for clarity according to an example embodiment of the present subject matter.
Figure 6:
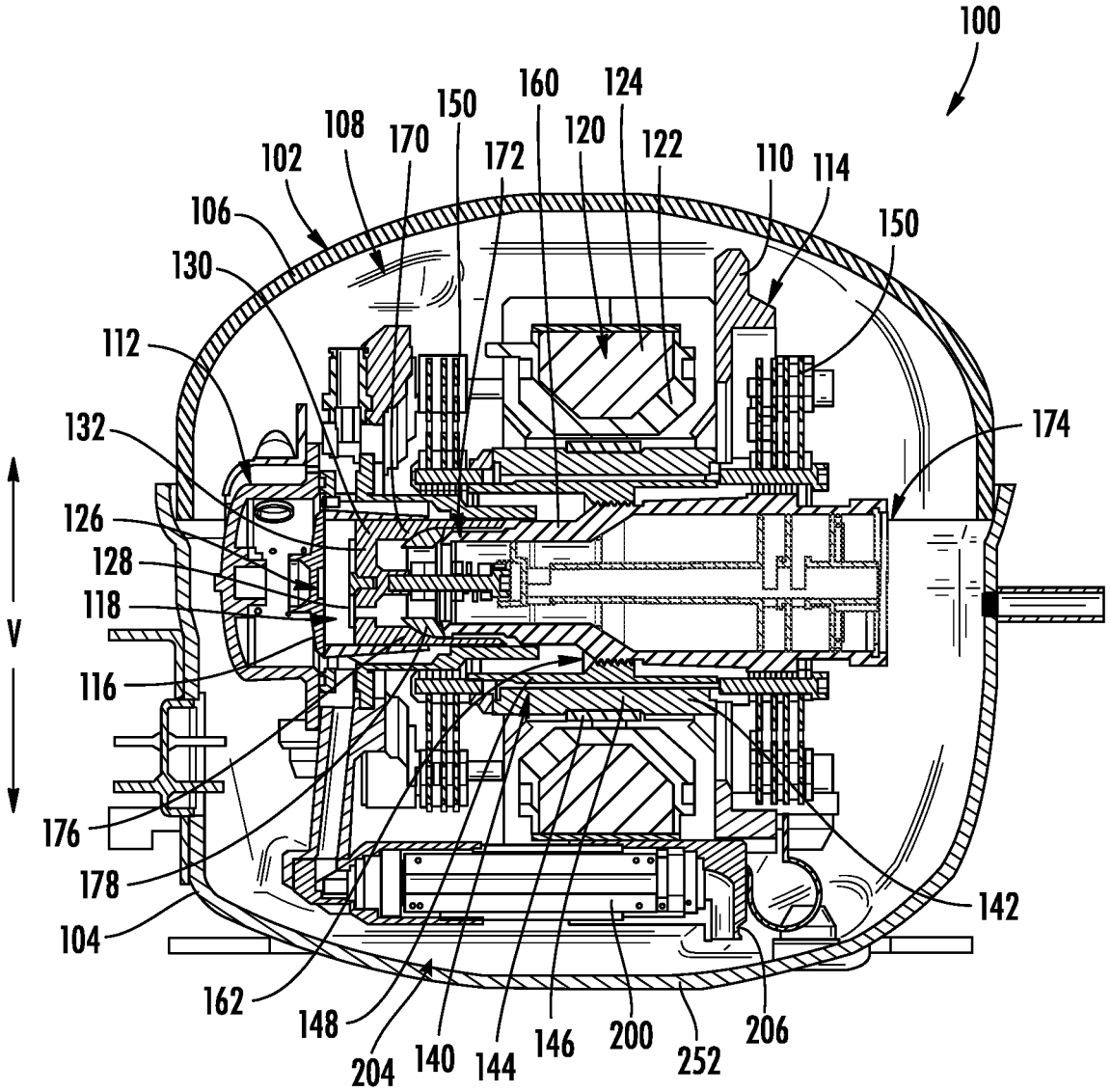
FIG. 6 is a section view of the exemplary linear compressor of FIG. 3 with a piston in an extended position according to an exemplary embodiment of the present subject matter.
Figure 7:
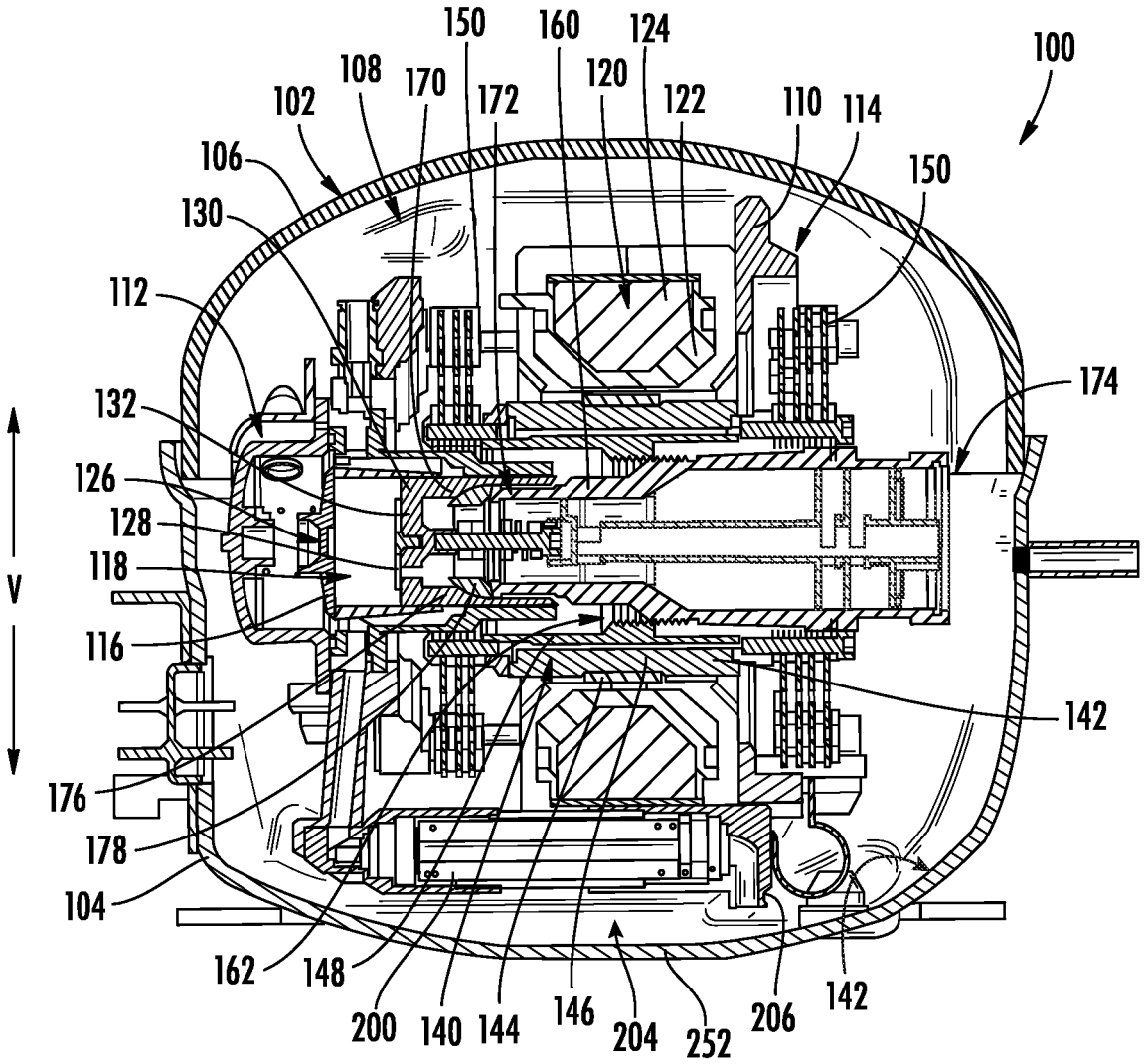
FIG. 7 is a section view of the exemplary linear compressor of FIG. 3 with the piston in a retracted position according to an exemplary embodiment of the present subject matter.

Referring now generally to FIGS. 3 through 7, a linear compressor 100 will be described according to exemplary embodiments of the present subject matter. Specifically, FIGS. 3 and 4 provide perspective, section views of linear compressor 100, FIG. 5 provides a perspective view of linear compressor 100 with a compressor shell or housing 102 removed for clarity, and FIGS. 6 and 7 provide section views of linear compressor when a piston is in an extended and retracted position, respectively. It should be appreciated that linear compressor 100 is used herein only as an exemplary embodiment to facilitate the description of aspects of the present subject matter. Modifications and variations may be made to linear compressor 100 while remaining within the scope of the present subject matter. Indeed, aspects of the present subject matter are applicable to any suitable piston-actuated or reciprocating compressor.

As illustrated for example in FIGS. 3 and 4, housing 102 may include a lower portion or lower housing 104 and an upper portion or upper housing 106 which are joined together to form a substantially enclosed cavity 108 for housing various components of linear compressor 100. Specifically, for example, cavity 108 may be a hermetic or air-tight shell that can house working components of linear compressor 100 and may hinder or prevent refrigerant from leaking or escaping from refrigeration system 60. In addition, linear compressor 100 generally defines an axial direction A, a radial direction R, and a circumferential direction C. It should be appreciated that linear compressor 100 is described and illustrated herein only to describe aspects of the present subject matter. Variations and modifications to linear compressor 100 may be made while remaining within the scope of the present subject matter.

Referring now generally to FIGS. 3 through 7, various parts and working components of linear compressor 100 will be described according to an exemplary embodiment. As shown, linear compressor 100 includes a casing 110 that extends between a first end portion 112 and a second end portion 114, e.g., along the axial direction A. Casing 110 includes a cylinder 117 that defines a chamber 118. Cylinder 117 is positioned at or adjacent first end portion 112 of casing 110. Chamber 118 extends longitudinally along the axial direction A. As discussed in greater detail below, linear compressor 100 is operable to increase a pressure of fluid within chamber 118 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2).

Linear compressor 100 includes a stator 120 of a motor that is mounted or secured to casing 110. For example, stator 120 generally includes an outer back iron 122 and a driving coil 124 that extend about the circumferential direction C within casing 110. Linear compressor 100 also includes one or more valves that permit refrigerant to enter and exit chamber 118 during operation of linear compressor 100. For example, a discharge muffler 126 is positioned at an end of chamber 118 for regulating the flow of refrigerant out of chamber 118, while a suction valve 128 (shown only in FIGS. 6-7 for clarity) regulates flow of refrigerant into chamber 118.

A piston 130 with a piston head 132 is slidably received within chamber 118 of cylinder 117. In particular, piston 130 is slidable along the axial direction A. During sliding of piston head 132 within chamber 118, piston head 132 compresses refrigerant within chamber 118. As an example, from a top dead center position (see, e.g., FIG. 6), piston head 132 can slide within chamber 118 towards a bottom dead center position (see, e.g., FIG. 7) along the axial direction A, i.e., an expansion stroke of piston head 132. When piston head 132 reaches the bottom dead center position, piston head 132 changes directions and slides in chamber 118 back towards the top dead center position, i.e., a compression stroke of piston head 132. It should be understood that linear compressor 100 may include an additional piston head and/or additional chambers at an opposite end of linear compressor 100. Thus, linear compressor 100 may have multiple piston heads in alternative exemplary embodiments.

As illustrated, linear compressor 100 also includes a mover 140 which is generally driven by stator 120 for compressing refrigerant. Specifically, for example, mover 140 may include an inner back iron 142 positioned in stator 120 of the motor. In particular, outer back iron 122 and/or driving coil 124 may extend about inner back iron 142, e.g., along the circumferential direction C. Inner back iron 142 also has an outer surface that faces towards outer back iron 122 and/or driving coil 124. At least one driving magnet 144 is mounted to inner back iron 142, e.g., at the outer surface of inner back iron 142.

Driving magnet 144 may face and/or be exposed to driving coil 124. In particular, driving magnet 144 may be spaced apart from driving coil 124, e.g., along the radial direction R by an air gap. Thus, the air gap may be defined between opposing surfaces of driving magnet 144 and driving coil 124. Driving magnet 144 may also be mounted or fixed to inner back iron 142 such that an outer surface of driving magnet 144 is substantially flush with the outer surface of inner back iron 142. Thus, driving magnet 144 may be inset within inner back iron 142. In such a manner, the magnetic field from driving coil 124 may have to pass through only a single air gap between outer back iron 122 and inner back iron 142 during operation of linear compressor 100, and linear compressor 100 may be more efficient relative to linear compressors with air gaps on both sides of a driving magnet.

As may be seen in FIG. 3, driving coil 124 extends about inner back iron 142, e.g., along the circumferential direction C. In alternative example embodiments, inner back iron 142 may extend around driving coil 124 along the circumferential direction C. Driving coil 124 is operable to move the inner back iron 142 along the axial direction A during operation of driving coil 124. As an example, a current may be induced within driving coil 124 by a current source (not shown) to generate a magnetic field that engages driving magnet 144 and urges piston 130 to move along the axial direction A in order to compress refrigerant within chamber 118 as described above and will be understood by those skilled in the art. In particular, the magnetic field of driving coil 124 may engage driving magnet 144 in order to move inner back iron 142 and piston head 132 along the axial direction A during operation of driving coil 124. Thus, driving coil 124 may slide piston 130 between the top dead center position and the bottom dead center position, e.g., by moving inner back iron 142 along the axial direction A, during operation of driving coil 124.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 124 of the motor. Thus, the controller may selectively activate driving coil 124, e.g., by inducing current in driving coil 124, in order to compress refrigerant with piston 130 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Inner back iron 142 further includes an outer cylinder 146 and an inner sleeve 148. Outer cylinder 146 defines the outer surface of inner back iron 142 and also has an inner surface positioned opposite the outer surface of outer cylinder 146. Inner sleeve 148 is positioned on or at inner surface of outer cylinder 146. A first interference fit between outer cylinder 146 and inner sleeve 148 may couple or secure outer cylinder 146 and inner sleeve 148 together. In alternative exemplary embodiments, inner sleeve 148 may be welded, glued, fastened, or connected via any other suitable mechanism or method to outer cylinder 146.

Outer cylinder 146 may be constructed of or with any suitable material. For example, outer cylinder 146 may be constructed of or with a plurality of (e.g., ferromagnetic) laminations. The laminations are distributed along the circumferential direction C in order to form outer cylinder 146 and are mounted to one another or secured together, e.g., with rings pressed onto ends of the laminations. Outer cylinder 146 may define a recess that extends inwardly from the outer surface of outer cylinder 146, e.g., along the radial direction R. Driving magnet 144 is positioned in the recess on outer cylinder 146, e.g., such that driving magnet 144 is inset within outer cylinder 146.

Linear compressor 100 also includes a pair of planar springs 150. Each planar spring 150 may be coupled to a respective end of inner back iron 142, e.g., along the axial direction A. During operation of driving coil 124, planar springs 150 support inner back iron 142. In particular, inner back iron 142 is suspended by planar springs 150 within the stator or the motor of linear compressor 100 such that motion of inner back iron 142 along the radial direction R is hindered or limited while motion along the axial direction A is relatively unimpeded. Thus, planar springs 150 may be substantially stiffer along the radial direction R than along the axial direction A. In such a manner, planar springs 150 can assist with maintaining a uniformity of the air gap between driving magnet 144 and driving coil 124, e.g., along the radial direction R, during operation of the motor and movement of inner back iron 142 on the axial direction A. Planar springs 150 can also assist with hindering side pull forces of the motor from transmitting to piston 130 and being reacted in cylinder 117 as a friction loss.

A flex mount 160 is mounted to and extends through inner back iron 142. In particular, flex mount 160 is mounted to inner back iron 142 via inner sleeve 148. Thus, flex mount 160 may be coupled (e.g., threaded) to inner sleeve 148 at the middle portion of inner sleeve 148 and/or flex mount 160 in order to mount or fix flex mount 160 to inner sleeve 148. Flex mount 160 may assist with forming a coupling 162. Coupling 162 connects inner back iron 142 and piston 130 such that motion of inner back iron 142, e.g., along the axial direction A, is transferred to piston 130.

Coupling 162 may be a compliant coupling that is compliant or flexible along the radial direction R. In particular, coupling 162 may be sufficiently compliant along the radial direction R such that little or no motion of inner back iron 142 along the radial direction R is transferred to piston 130 by coupling 162. In such a manner, side pull forces of the motor are decoupled from piston 130 and/or cylinder 117 and friction between piston 130 and cylinder 117 may be reduced.

As may be seen in the figures, piston head 132 of piston 130 has a piston cylindrical side wall 170. Cylindrical side wall 170 may extend along the axial direction A from piston head 132 towards inner back iron 142. An outer surface of cylindrical side wall 170 may slide on cylinder 117 at chamber 118 and an inner surface of cylindrical side wall 170 may be positioned opposite the outer surface of cylindrical side wall 170. Thus, the outer surface of cylindrical side wall 170 may face away from a center of cylindrical side wall 170 along the radial direction R, and the inner surface of cylindrical side wall 170 may face towards the center of cylindrical side wall 170 along the radial direction R.

Flex mount 160 extends between a first end portion 172 and a second end portion 174, e.g., along the axial direction A. According to an exemplary embodiment, the inner surface of cylindrical side wall 170 defines a ball seat 176 proximate first end portion. In addition, coupling 162 also includes a ball nose 178. Specifically, for example, ball nose 178 is positioned at first end portion 172 of flex mount 160, and ball nose 178 may contact flex mount 160 at first end portion 172 of flex mount 160. In addition, ball nose 178 may contact piston 130 at ball seat 176 of piston 130. In particular, ball nose 178 may rest on ball seat 176 of piston 130 such that ball nose 178 is slidable and/or rotatable on ball seat 176 of piston 130. For example, ball nose 178 may have a frusto-spherical surface positioned against ball seat 176 of piston 130, and ball seat 176 may be shaped complementary to the frusto-spherical surface of ball nose 178. The frusto-spherical surface of ball nose 178 may slide and/or rotate on ball seat 176 of piston 130.

Relative motion between flex mount 160 and piston 130 at the interface between ball nose 178 and ball seat 176 of piston 130 may provide reduced friction between piston 130 and cylinder 117, e.g., compared to a fixed connection between flex mount 160 and piston 130. For example, when an axis on which piston 130 slides within cylinder 117 is angled relative to the axis on which inner back iron 142 reciprocates, the frusto-spherical surface of ball nose 178 may slide on ball seat 176 of piston 130 to reduce friction between piston 130 and cylinder 117 relative to a rigid connection between inner back iron 142 and piston 130.

Flex mount 160 is connected to inner back iron 142 away from first end portion 172 of flex mount 160. For example, flex mount 160 may be connected to inner back iron 142 at second end portion 174 of flex mount 160 or between first and second end portions 172, 174 of flex mount 160. Conversely, flex mount 160 is positioned at or within piston 130 at first end portion 172 of flex mount 160.

As explained briefly above, compressors such as linear compressor 100 may be a source of significant noise in various applications, such as refrigerator appliance applications. For example, with linear compressor designs, oil returning to the sump may be a significant source of noise. One solution to this noise may be to add a small amount of low viscosity silicone oil to the compressor lubrication oil. This oil may cause a thin layer of foam to form on the surface of the oil and reduce the sound level caused by oil dripping and sloshing within the shell. However, the use of such silicone oil may result in the accumulation of oil at the exit of the cap tube or pump inlet, resulting in undesirable restrictions. Alternatively, long term chemical compatibility may be a concern and the use of such oil may be ineffective during compressor startup because the foam generated on the surface has settled. Accordingly, aspects of the present subject matter are directed to other products and methods for reducing sounds associated with oil in the sump of a compressor, particularly in a reciprocating compressor such as linear compressor 100.

Figure 8:
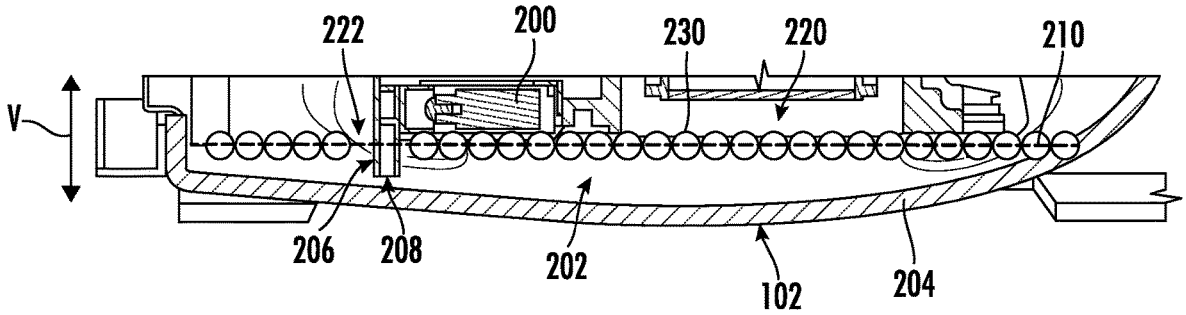
FIG. 8 provides a close-up, section view of a sump of the exemplary linear compressor of FIG. 3 including noise reduction media according to an exemplary embodiment of the present subject matter.

Referring now specifically to FIG. 8, linear compressor 100 may include a lubrication pump 200 that is generally configured for circulating a lubricant 202 (e.g., such as oil) to various portions of linear compressor 100. The lubricant 202 may then collect back within sump 204 of housing 102. In addition, lubrication pump 200 may include a lubricant intake tube 206 that extends down along the vertical direction V into sump 204 to facilitate intake of lubricant 202. In this regard, a distal end of lubricant intake tube 206 may define a pump inlet 208.

Notably, linear compressor 100 is commonly filled with a predetermined volume of lubricant 202, e.g., based on the lubrication needs and pump positioning of the linear compressor 100. It may be desirable to ensure that pump inlet 208 remains submerged in lubricant 202 throughout operation of linear compressor 100, e.g., to prevent unlubricated compressor operation and potential compressor damage, noise, etc. Accordingly, housing 102 may generally define a lubricant fill line 210 to which lubricant 202 is added to ensure proper, safe operation of linear compressor 100. According to exemplary embodiments, pump inlet 208 is positioned below lubricant fill line 210, e.g., such that pump inlet 208 is submerged by at least 1 mm, at least 3 mm, at least 5 mm, at least 10 mm, or greater.

Notably, as explained above, lubricant 202 may have a tendency to generate noise during operation of linear compressor 100. For example, lubricant 202 that drips off working components of linear compressor 100 and falls into sump 204 may make splashing sounds. In addition, because lubricant intake tube 206 is oscillating along with casing 110 while being submerged within lubricant 202, lubricant intake tube 206 tends to impart energy into lubricant 202, e.g., making sloshing sounds, splashing lubricant 202 onto the walls of housing 102, generating waves that strike housing 102, etc. Aspects of the present subject matter are directed to features and methods for reducing such undesirable noises.

Specifically, according to example embodiments, linear compressor 100 may include a noise dissipation media 220 that is positioned within sump 204 and is generally configured for reducing noise associated with dripping, splashing, spraying, or sloshing lubricant 202. For example, noise dissipation media 220 may be a floating media that sits on a surface of lubricant 202 that has collected in sump 204 such that it is floating above pump inlet 208. In general, noise dissipation media 220 may be constructed from a material that has a lower density than lubricant 202 and is thus buoyant when placed in lubricant 202. In addition, noise dissipation media 220 may generally be constructed from an inert material that does not react chemically with lubricant 202. Although exemplary noise dissipation media 220 will be described below, it should be appreciated that variations and modifications to these materials and their configuration within linear compressor 100 are possible and within the scope of the present subject matter.

Notably, it may be desirable to prevent noise dissipation media 220 from contacting lubricant intake tube 206 during operation of linear compressor 100. Accordingly, noise dissipation media 220 and/or linear compressor 100 may include features that prevent contact between noise dissipation media 220 and lubricant intake tube 206. For example, these features of linear compressor 100, some of which will be described below according to example embodiments, may be generally configured to define a media void 222 around lubricant intake tube 206. In this regard, for example, media void 222 may be a substantially circular region that may be concentric with lubricant intake tube 206 and where noise dissipation media 220 is not located but within which lubricant 202 may flow.

Figure 9:
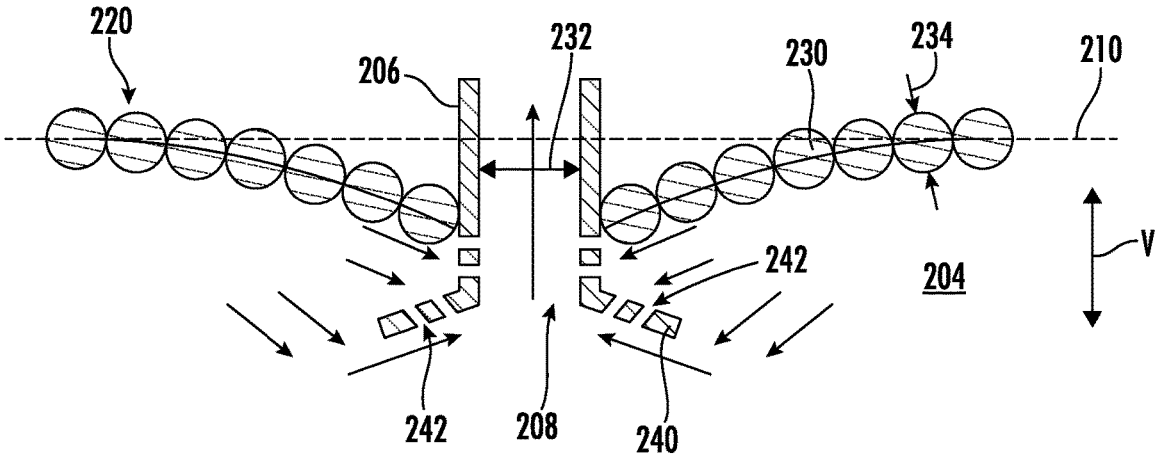
FIG. 9 provides a side, schematic view of a lubricant intake tube sitting within lubricant in the sump of the exemplary linear compressor of FIG. 3 according to an exemplary embodiment of the present subject matter.
Figure 10:
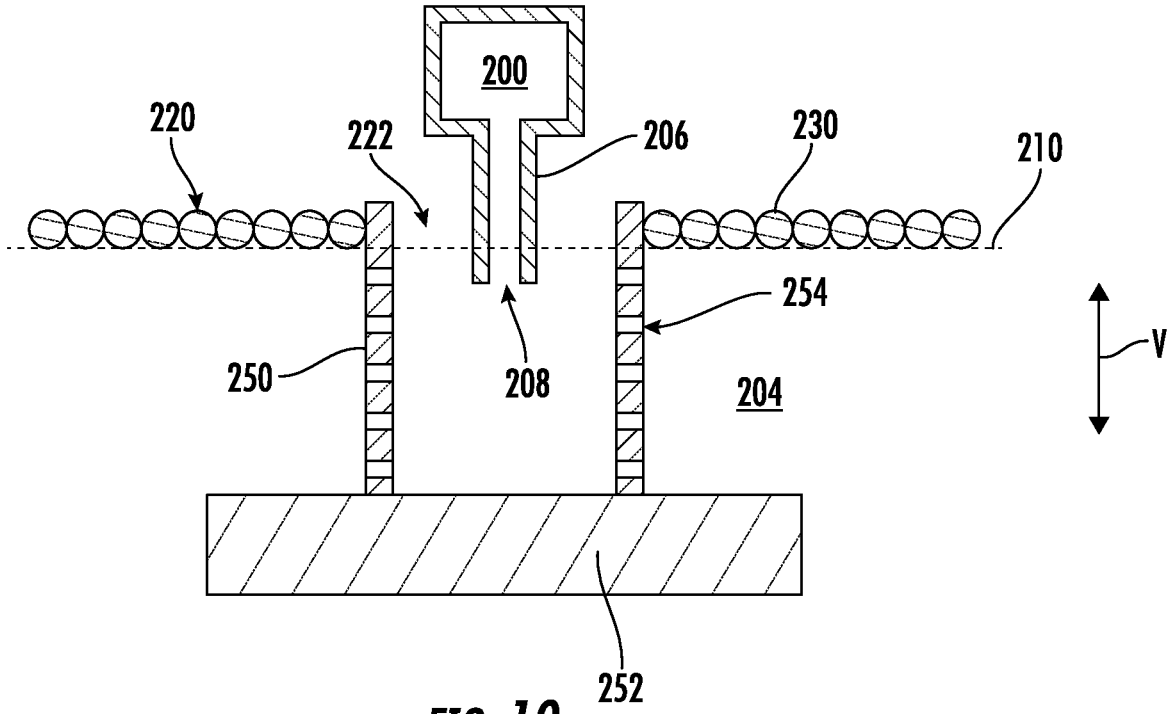
FIG. 10 provides a side, schematic view of a lubricant intake tube and a blocking structure sitting within lubricant in the sump of the exemplary linear compressor of FIG. 3 according to an exemplary embodiment of the present subject matter.

For example, referring now specifically to FIGS. 8 through 10, noise dissipation media 220 may comprise a plurality of floating balls 230 that are positioned within sump 204 and that float on top of lubricant 202. According to example embodiments, balls 230 may form an even layer on top of lubricant 202 and may cover substantially the entire surface of lubricant 202 except for media void 222. Balls 230 may generally be constructed of any suitably inert and buoyant material, such as open cell foam, a deformable polymer material, or any other suitable plastic and nonreactive material.

According to example embodiments, balls 230 may be substantially spherical, e.g., to permit smooth movement and dispersion along a surface of lubricant 202 while dissipating wave energy within lubricant 202. According to still other embodiments, balls 230 may have a non-spherical shape. For example, according to an example embodiment, pump inlet 208 may define and inlet diameter 232 and balls 230 may have at least one dimension (e.g., indicated as a ball diameter 234 in FIG. 9). According to an example embodiment where balls 230 are spherical, ball diameter 234 may be greater than inlet diameter 232, e.g., to prevent balls 230 from being drawn into lubrication pump 200. According to still other embodiments where balls 230 are non-spherical, at least one dimension 234 may be larger than inlet diameter 232, e.g., to prevent clogging pump inlet 208 while preventing balls 230 from entering pump inlet 208. Other sizes and shapes are possible and within the scope of the present subject matter.

According to one example embodiment as shown in FIG. 9, balls 230 may be permitted to reach lubricant intake tube 206. However, in order to prevent the balls 230 from being sucked into pump inlet 208, lubricant intake tube 206 may define a flared end 240 that is positioned below lubricant fill line 210. In general, flared end 240 may reduce the depression in the surface of lubricant 202 near lubricant intake tube 206, thereby increasing the distance between balls 230 and pump inlet 208. In addition, flared end 240 may generally define intake apertures 242 that are sized to prevent passage of balls 230 through flared end 240.

Referring now specifically to FIG. 10, linear compressor 100 may include a blocking structure 250 that generally extends from housing 102 to prevent balls 230 from contacting lubricant intake tube 206. In other words, blocking structure 250 may be positioned around lubricant intake tube 206 in a manner that defines media void 222. According to the illustrated embodiment, blocking structure 250 extends from a bottom wall 252 of housing 102 upward along the vertical direction V through sump 204 to a position above pump inlet 208. More specifically, blocking structure 250 may extend above lubricant fill line 210. In this manner, balls 230 are not able to reach lubricant intake tube 206. It should be appreciated that blocking structure 250 may define a plurality of structure apertures 254 to permit free flow of lubricant 202 through blocking structure 250 and into pump inlet 208. In this regard, each structure aperture 254 may have a screen aperture size that is smaller than ball diameter 234.

Figure 11:
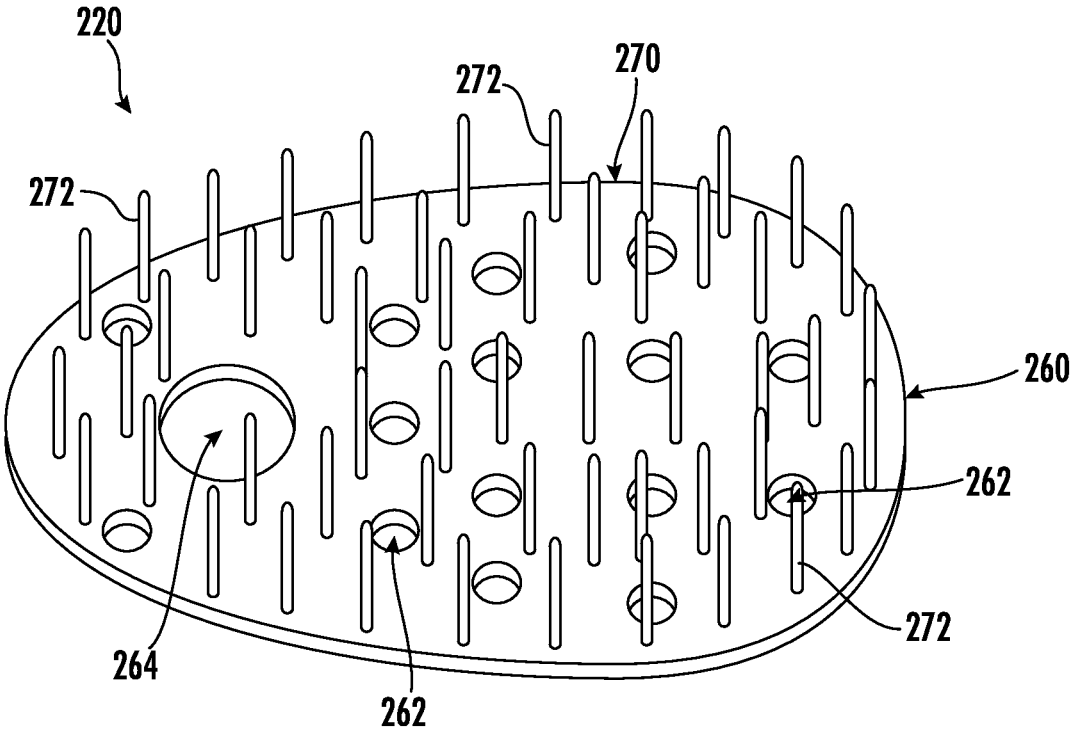
FIG. 11 provides a perspective view of a buoyant mat that may be used as a noise reduction media within the sump of the exemplary linear compressor of FIG. 3 according to an exemplary embodiment of the present subject matter.

Referring now specifically to FIG. 11, according to an alternative embodiment, noise dissipation media 220 may include a buoyant mat 260 that sits on a surface of lubricant 202 and does not contact lubricant intake tube 206. In this regard, as illustrated, buoyant mat 260 may define one or more apertures 262 for permitting lubricant 202 that falls from components of linear compressor 100 to flow back into sump 204 (e.g., in a manner that is quieter than directly dripping into sump 204). In addition, buoyant mat 260 may define a tube aperture 264 that is generally sized and configured to receive lubricant intake tube 206 and define media void 222. Buoyant mat 260 may be generally configured for dissipating wave motion or splashing of lubricant 202 within sump 204.

Notably, it may be desirable to align tube aperture 264 with lubricant intake tube 206. Accordingly, according to an example embodiment, buoyant mat 260 may be sized such that it has a plurality of edges 270 that are configured to contact housing 102 in a manner that positions buoyant mat 260 at a known location and aligns tube aperture 264 such that is concentric with lubricant intake tube 206. According to still other embodiments, linear compressor may include a blocking structure, e.g., such as blocking structure 250 that passes through tube aperture 264 to fix the position of buoyant mat 260.

Referring still to FIG. 11, buoyant mat 260 may include additional features that improve the noise dissipation of noise dissipation media 220. For example, according to the illustrated embodiment, noise dissipation media 220 further includes a plurality of tines 272 that are positioned on or extend from a top surface of buoyant mat 260 upward along the vertical direction V. In this manner, noise from lubricant 202 falling from above may be reduced as well as lubricant 202 splashing along a horizontal direction. Noise dissipation media 220 may include any other suitable number of pumps, protrusions, or other protruding features that are designed to dampen the motion of lubricant 202 within sump 204 or otherwise reduce noise caused by lubricant 202.

As described herein, aspects of the present subject matter are generally directed to a linear compressor and a floating media that may be added into the sump of the linear compressor to facilitate noise reduction. In this regard, for example, a layer of thin plastic mesh may be added to the top of the oil sump in the compressor and this plastic media floats with the oil level. Alternatively, a layer of floating plastic beads may be added to the oil. In both cases, the additional media may act to form an irregular layer between the sump oil and the free space above, and that layer may dampen the sounds produced by spraying/sloshing of the oil to the surroundings and oil returning to the sump. The size of the dampening media may preferably be small enough not to interfere with the lower part of the compressor case and not be pulled into or block the intake tube. In addition, the inlet tube of the oil pump may be notched, flared, or perforated (like a course filter) to reduce local oil-level depressions. A lower depression of oil near the intake tube may reduce the likelihood of the floating media entering or plugging the inlet, e.g., as a larger area of suction influence will reduce the depth of the depression.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A compressor defining an axial direction and a vertical direction, the compressor comprising:

a housing defining a sump for collecting lubricant;

a pump for circulating the lubricant within the housing, the pump comprising a lubricant intake tube defining a pump inlet positioned within the sump; and a noise dissipation media positioned within the sump on a surface of the lubricant and above the pump inlet, wherein a media void is defined around the lubricant intake tube.

2. The compressor of claim 1, wherein the noise dissipation media has a lower density than the lubricant.

3. The compressor of claim 1, wherein the noise dissipation media is constructed from an inert material that does not react chemically with the lubricant.

4. The compressor of claim 1, wherein the noise dissipation media comprises a buoyant mat defining one or more apertures and a tube aperture configured to receive the lubricant intake tube and define the media void.

5. The compressor of claim 4, wherein the noise dissipation media further comprises:

a plurality of tines that protrude upward along a vertical direction from the buoyant mat.

6. The compressor of claim 4, wherein the buoyant mat comprises:

a plurality of edges that are configured to contact the housing and align the tube aperture with the lubricant intake tube.

7. The compressor of claim 4, further comprising:

a blocking structure that extends from the housing and contacts the buoyant mat to align the tube aperture with the lubricant intake tube.

8. The compressor of claim 1, wherein the noise dissipation media comprises a plurality of floating balls.

9. The compressor of claim 8, wherein at least one of the plurality of floating balls is constructed of open cell foam.

10. The compressor of claim 8, wherein at least one of the plurality of floating balls is constructed from a deformable polymer material.

11. The compressor of claim 8, wherein at least one of the plurality of floating balls has a non-spherical shape with at least one dimension larger than an inlet diameter of the pump inlet.

12. The compressor of claim 8, further comprising:

a blocking structure that extends from a bottom wall of the housing upward along the vertical direction and has a screen aperture size smaller than the plurality of floating balls.

13. The compressor of claim 1, wherein the lubricant intake tube defines a flared end at the pump inlet.

14. The compressor of claim 13, wherein the flared end is positioned below a lubricant fill line.

15. The compressor of claim 13, wherein the flared end defines intake apertures sized to prevent passage of the noise dissipation media.

16. The compressor of claim 1, wherein the housing defines a lubricant fill line and the pump inlet is positioned below the lubricant fill line.

17. A noise dissipation media for use in a linear compressor, the linear compressor comprising a housing defining a sump and a lubricant intake tube defining a pump inlet positioned within the sump, the noise dissipation media comprising:

a buoyant mat defining one or more apertures and a tube aperture configured to receive the lubricant intake tube and define a media void around the lubricant intake tube.

18. The noise dissipation media of claim 17, further comprising:

a plurality of tines that protrude upward along a vertical direction from the buoyant mat.

19. The noise dissipation media of claim 17, further comprising:

a blocking structure that extends from the housing and contacts the buoyant mat to align the tube aperture with the lubricant intake tube.

20. The noise dissipation media of claim 17, wherein the noise dissipation media has a lower density than a lubricant and is constructed from an inert material that does not react chemically with the lubricant.

* * * * *